US005365593A

United States Patent [19]

Greenwood et al.

[11] Patent Number: 5,365,593

[45] Date of Patent: Nov. 15, 1994

[54] DECORATIVE AND OPERATIVE HEARING AID ATTACHMENT

[75] Inventors: Jean B. Greenwood, Warren, Ohio; J. Stephen Tenbarge, Clearwater, Fla.

[73] Assignee: Jeanie HearRing, Inc., Warren, Ohio

[21] Appl. No.: 34,567

[22] Filed: Mar. 19, 1993

[51] Int. Cl.[5] ..... H04R 25/00

[52] U.S. Cl. ..... 381/69; 381/68.6; 200/52 R

[58] Field of Search ..... 381/68.6, 68, 69, 69.2, 381/183, 187; 200/52 R, DIG. 2, 5 A

[56] References Cited

U.S. PATENT DOCUMENTS

| | | | |
|---|---|---|---|
| D. 176,512 | 1/1956 | Hagedorn | 45/9 |
| 2,595,672 | 5/1952 | Greenwood | 41/34 |
| 2,909,619 | 10/1959 | Hollingsworth | 179/107 |
| 3,549,828 | 12/1970 | Lang | 381/68.6 |
| 3,952,176 | 4/1976 | Holder et al. | 200/52 R |
| 4,029,515 | 6/1977 | Ojima | 200/5 A |
| 4,329,676 | 5/1982 | McDonald et al. | 381/69.2 |
| 4,679,240 | 7/1987 | Heide | 381/68.6 |
| 4,803,853 | 2/1989 | Hoerkens | 63/14.1 |

FOREIGN PATENT DOCUMENTS

| | | | |
|---|---|---|---|
| 3-276529 | 6/1991 | Japan | 200/52 R |

*Primary Examiner*—Curtis Kuntz
*Assistant Examiner*—Huyen Le
*Attorney, Agent, or Firm*—Pettis & McDonald

[57] ABSTRACT

The present invention relates to a decorative and operative attachment for hearing aids that have a volume control. The attachment comprises a decorative element that is sized to conceal the hearing aid from view and an attaching device for attaching the decorative element to the hearing aid so that the decorative attachment may operatively control the volume of the hearing aid.

6 Claims, 3 Drawing Sheets

DECORATIVE AND OPERATIVE HEARING AID ATTACHMENT

BACKGROUND OF THE INVENTION

1. Field of the Invention

The present invention relates to a decorative and operative attachment for a hearing aid having a volume control. The decorative element of the invention conceals the hearing aid, while the decorative element and the attaching means provide easy control of the hearing aid volume.

2. Description of the Prior Art

Hearing aids are generally unattractive, detracting from the appearance of the wearer. U.S. Pat. No. Des. 176,512, issued to Anthony W. Hagedorn discloses a large hearing aid that is external to the wearer's ear. The hearing aid is enclosed in a more attractive case. U.S. Pat. No. 2,909,619 to Maurice Hollingsworth, discloses a decorative device that is clipped to the outside of a hearing aid case that is suspended from the earlobe of the wearer. The volume control projects from the hearing aid and is hidden behind the decorative device.

As hearing aids became smaller, through miniaturization of parts, it became possible to place the majority of the hearing aid within the ear or within the ear canal. U.S. Pat. No. 2,595,672 to Dorothea Greenwood, illustrates the smaller style hearing aid. In this patent, a decorative device is clamped over the case of the hearing aid to hide the hearing aid from view. The location of the volume control is unclear.

U.S. Pat. No. 4,672,672, issued to Eggert et al., discloses a hearing aid with an enlarged volume control for easy operation by the user. The enlarged knob is not decorative and there is no suggestion that a decorative element should be attached to it.

When decorative elements are used to cover and camouflage hearing aids it becomes much more difficult for the wearer to operate the volume control, particularly those hearing aids that are small and contained within the exterior ear or within the ear canal. Therefore, it is clear that there is a need for a decorative element that not only serves to conceal or camouflage the hearing aid, but also provides easy control of the volume of the hearing aid. It is also preferable that such decorative elements be exchangeable for proper fashion coordination with the wearer's clothing.

SUMMARY OF THE INVENTION

The present invention relates to a decorative and operative attachment for a hearing aid that has a volume control. The control attachment comprises a decorative element that is sized to conceal the hearing aid from view and a volume control attaching means for attaching the decorative element to the volume control of the hearing aid. The method of attachment of the decorative element is designed so that movement of the attaching means will operate the volume control between a minimum position and a maximum position.

As there are many different types of hearing aids, many having a volume control of different design, it is necessary to provide different attaching means to attach the decorative element to the volume control. One embodiment of the attaching means may comprise a shaft that is mounted within a hole in the hearing aid volume control; another embodiment may comprise a snap fastener having one part attached to the volume control and the other attached to the decorative element. The volume control on some hearing aid models comprises two pairs of pins, one pair defining an open circuit, which when closed raises the volume, and the other pair of pins defining an open circuit, which when closed lowers the volume. When one pair of pins is touched by the user's finger, the moisture on the skin closes the circuit. The attaching means for this type of hearing aid comprises a pair of conductive strips attached to a decorative element. When the flexible decorative element is pressed, one conductive strip contacts the adjacent pair of the two pairs of pins closing the circuit.

The invention accordingly comprises an article of manufacture possessing the features, properties, and the relation of elements which will be exemplified in the article hereinafter described, the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings. Different embodiments utilize reference numbers increased in increments of 100.

DETAILED DESCRIPTION

Figure 1:
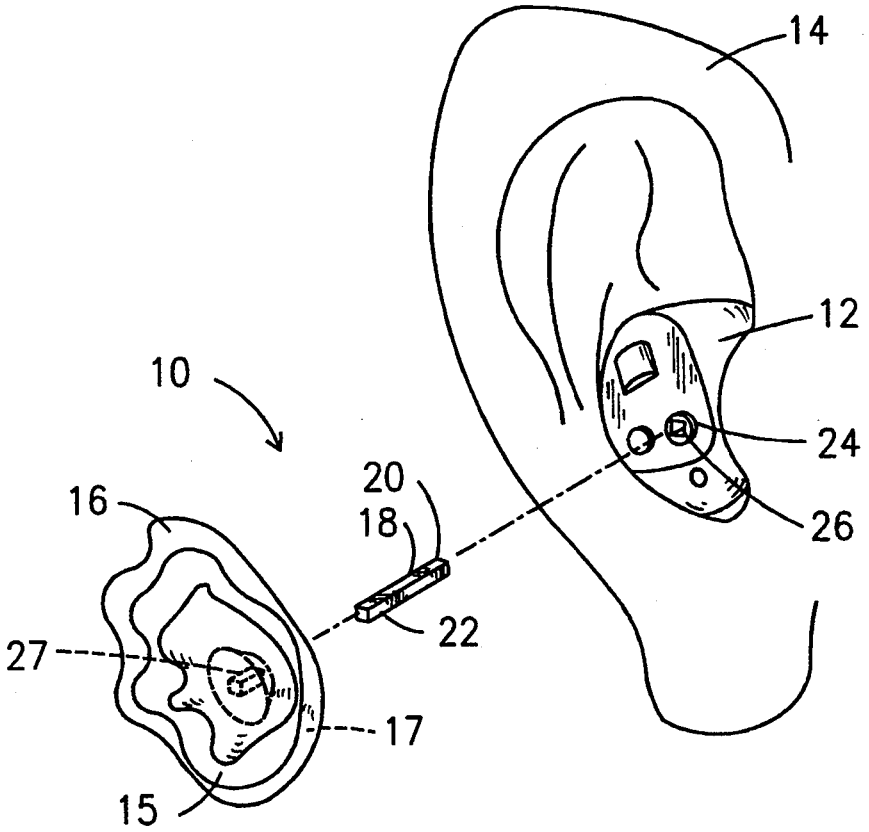
FIG. 1 is an exploded perspective view of one embodiment of this invention illustrating the attachment of the invention to a hearing aid.

A number of preferred embodiments for the decorative and operative hearing aid attachment of this invention are illustrated in the drawing FIGS. 1–9, in which the decorative attachment is generally indicated as 10 in the first embodiment and by increments of 100 in subsequent embodiments, e.g., 110, 210 and 310. The hearing aid is generally indicated as 12, and by increments of 100, and the user's ear is indicated as 14. Referring first to FIG. 1, a preferred embodiment of the decorative attachment 10 is shown in an exploded view in relation to a hearing aid 12 that is inserted in a person's ear 14.

The decorative attachment 10 comprises a decorative element 16 having a first side 15 and a second side 17 and a volume control attachment means, conveniently a shaft 18, having a first end 20 and a second end 22. The first side 15 of the decorative element 16 has decorations thereon and the second side 17 provides a surface for attaching the attaching means. The first end 20 is adapted for attachment to the hearing aid volume control 24 and the second end is attached to the second side 17 of the decorative element 16, so that rotation of the decorative element 16 rotates the shaft 18 and thus rotates the volume control 24 of the hearing aid 12. In this embodiment the volume control 24 of hearing aid 12 has a recess 26 with four equal sides. The first end 20 of the shaft 18 has four equal sides that are sized and configured to be received in recess 26 so that the shaft 18 is frictionally attached to the volume control 24. The friction fit permits easy removal when the decorative attachment 10 is not desired or a different decorative attachment is used. In other embodiments a right cross section of the recess 26 and the first end 20 of the shaft 18 may comprise a hexagon, octagon, semi-circle or any other convenient shape. The first end 20 of the shaft 18 may be glued to the volume control 24 or may be attached by engagement of threads on shaft 18 and in recess 26 or by any other method well known in the art. The second end 22 of the shaft 18 has four equal sides that are received by an aperture within a cap 27 that is attached to decorative element 16 by gluing or other means. The shaft 18 may be glued to the cap 27, it may be attached by a friction fit between the shaft 18 and to the cap 27 or it may be attached by engagement of threads on the second end 22 of shaft 18 with threads in the cap 27. In other embodiments the second end 22 of the shaft 18 may be attached directly to the second side 17 of the decorative element 16 by gluing or by other well-known means.

Figure 2:
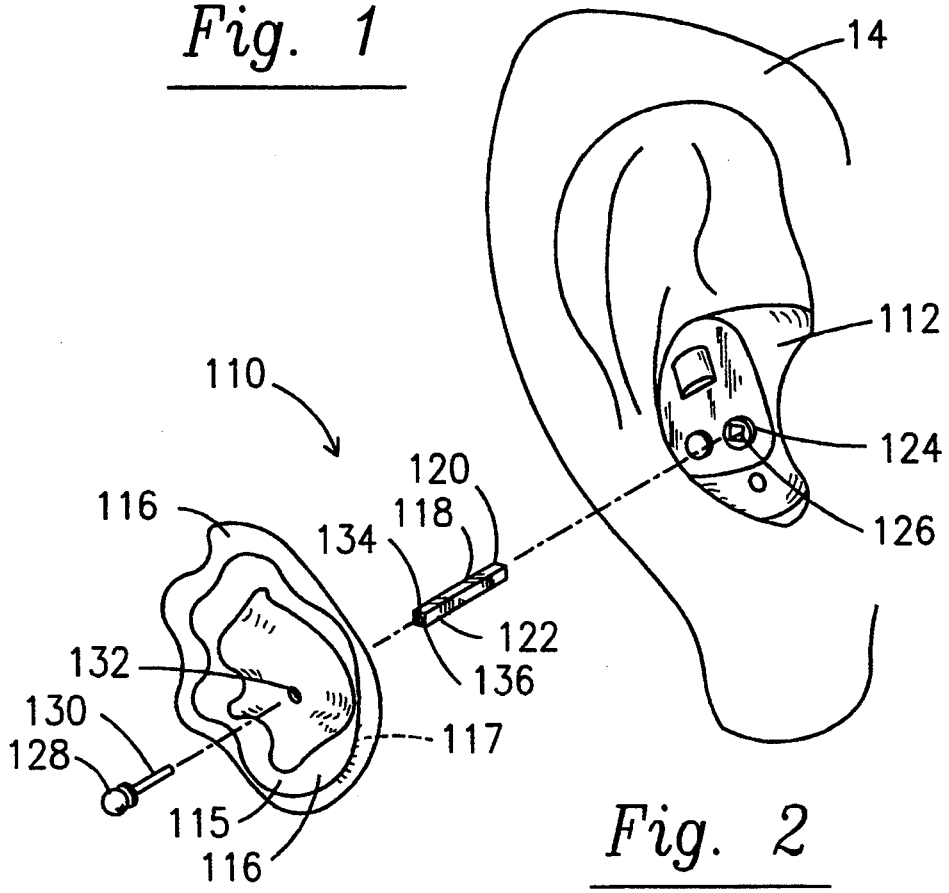
FIG. 2 is an exploded perspective view of a second embodiment of this invention illustrating the attachment of the invention to a hearing aid.

The attaching means of the decorative attachment 10 of FIG. 1 has been modified to create decorative attachment 110 in FIG. 2. The decorative attachment 110 further comprises a decorative knob 128 to which is attached a pin 130. The decorative element 116 further comprises an aperture 132 therethrough and the second end 122 of the shaft 118 further comprises a longitudinal bore 134 extending inwardly from the end surface 136 of the shaft 118. The decorative element 116 is mounted on the pin 130 so that the pin 130 extends through the decorative element 116 and is received by the bore 134 in shaft 118. The pin 130 is held in the bore 134 by a friction fit. The first end 120 of the shaft 118 is attached to the volume control 124 of hearing aid 110 in the same manner as in the first embodiment 10. Rotation of knob 128 causes the shaft 118 to rotate and thus causes the volume control 124 to rotate in the same direction. By rotating the knob 128 in clockwise and counter clockwise directions the volume control is operated between a position of minimum volume and a position of maximum volume.

Figure 3:
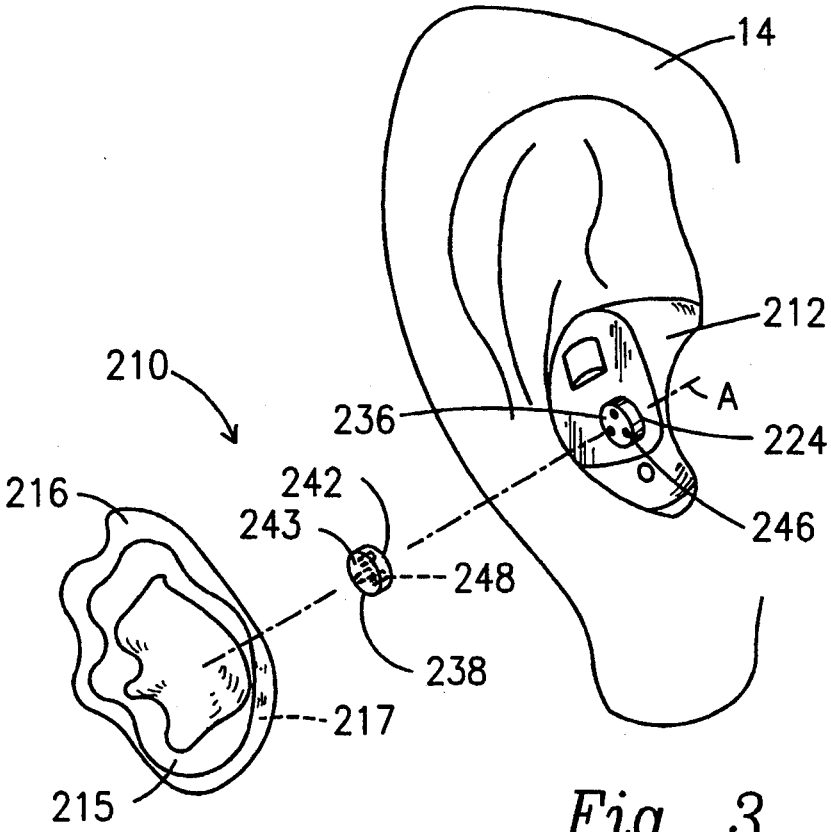
FIG. 3 is an exploded perspective view of a third embodiment of this invention illustrating the attachment of the invention to a hearing aid.
Figure 4:
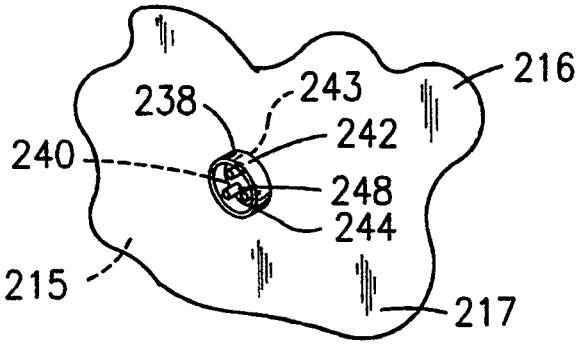
FIG. 4 is a rear perspective view of the invention of FIG. 3.

FIG. 3 illustrates a hearing aid 210 with a volume control 224 that is generally cylindrical with an outwardly facing end surface 236 in relation to the hearing aid 212 that is generally normal to the longitudinal axis A of the volume control 224. The attaching means, conveniently receptor 238 is cup-shaped having a bottom 240 and at least one wall 242 extending therefrom. The receptor 238 has an outer bottom surface 243 and an inner bottom surface 244. The outer bottom surface 243 is attached to the second side 217 of the decorative element 216 by gluing or any other well-known attaching method. The receptor 238 may theh be removably attached by a friction fit to the volume control 224. In another embodiment, to improve the resistance of the receptor 238 to rotating in relation to the volume control 224, the volume control 224 has at least one hole 246 extending inwardly from the outwardly facing end surface 236. The receptor further comprises at least one pin 248 extending outwardly from the inner bottom surface 244. When the receptor 238 is mounted on the volume control 224 the pin 248 is sized and aligned to be received by the hole 246. In a preferred embodiment illustrated in FIGS. 3 and 4 three pins 248 and three holes 246 are provided. Rotation of the decorative element 216 will cause rotation of the volume control 224 of the hearing aid 212 permitting easy adjustment of the volume. A number of decorative elements 216 having various designs and colors can each be provided with a receptor 238 so that the decorative element 216 may be selected that appropriately accents the clothing being worn.

Figure 5:
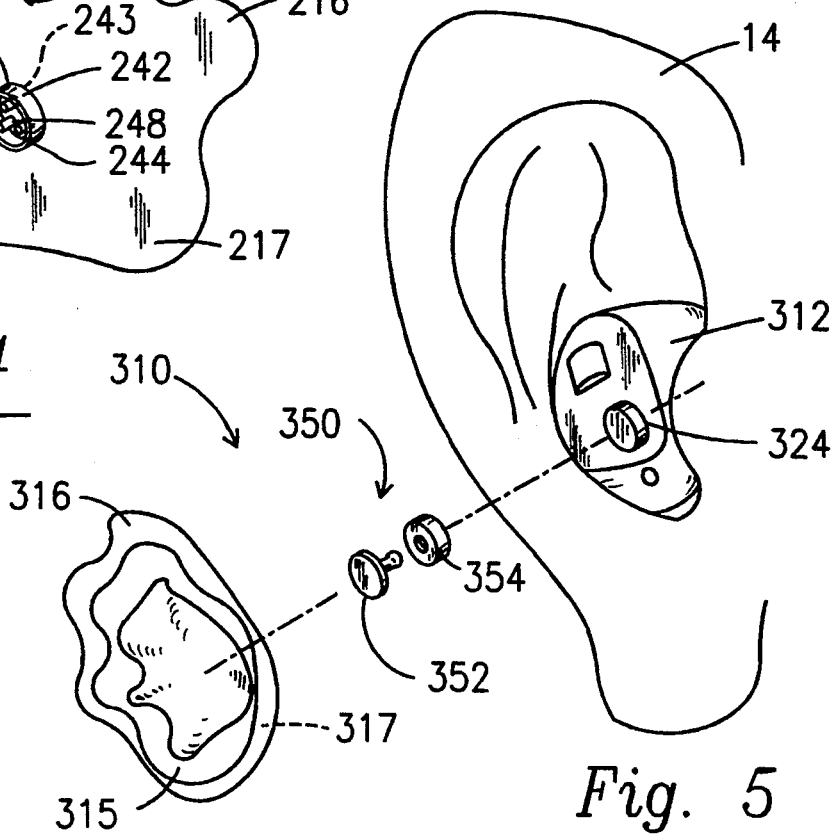
FIG. 5 is a perspective view of a fourth embodiment of this invention illustrating the attachment of the invention to a hearing aid.

Another embodiment of the decorative attachment 310 is illustrated in FIG. 5, which utilizes a snap-type fastener 350 having a first part 352 and a second part 354. By attaching one part 354 to the volume control 324 and the other part 352 to the second side 317 of the decorative element 316, the decorative element 316 may be easily attached and detached from the hearing aid 312. The snap fastener parts 352 and 354 when joined to one another must provide sufficient rotational resistance through friction so that when the decorative element 316 is rotated the volume control 324 is rotated with it. It is preferred that the female portion 354 of the snap fastener 350 be attached to the volume control 324, so that when the hearing aid 312 is worn without a decorative element 316, the least obtrusive part of the snap fastener 350 is seen.

Figure 7:
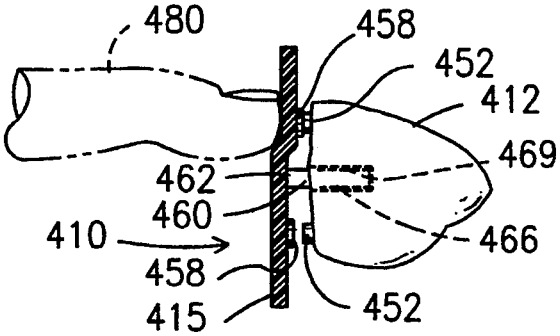
FIG. 7 is a side elevation of the invention of FIG. 6 illustrating the operation of the invention.
Figure 6:
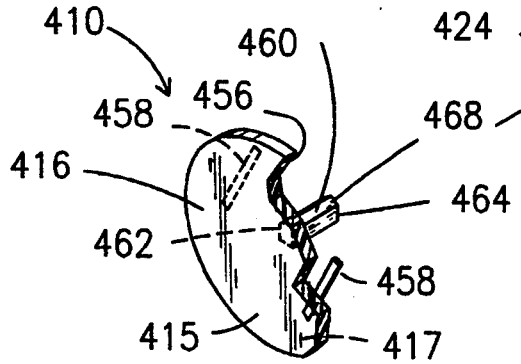
FIG. 6 is an exploded perspective view of a fifth embodiment of this invention with a portion of the decorative attachment broken away to more clearly illustrate the attachment of the invention to a hearing aid.
Figure 6:
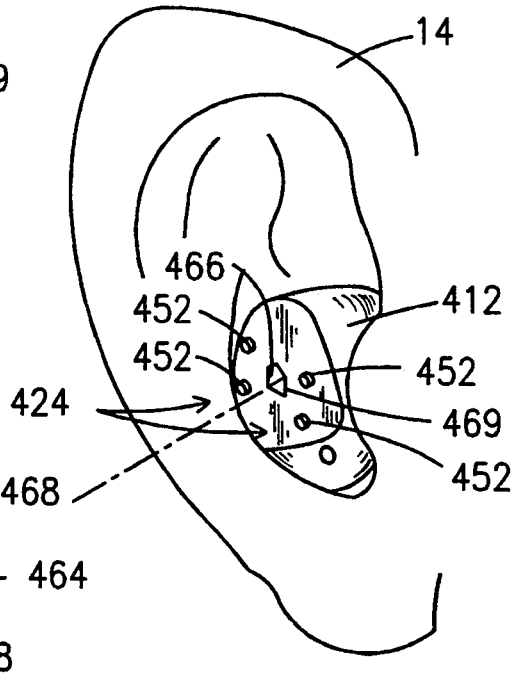

FIGS. 6 and 7 illustrate a decorative attachment 410 that is suitable for use with a hearing aid 412 that uses a volume control system comprised of two pair of conductive pegs 452 that extend outwardly from the hearing aid 412. Each pair of pegs 452 comprise the open ends of an electrical circuit. The volume control 424 of hearing aid 412 is designed so that closing one circuit increases the volume and closing only the other circuit decreases the volume. In the usual operation of the volume control 424 of hearing aid 412, the user places his finger upon one pair of the pegs 452 so that the moisture on the user's skin closes the circuit increasing or decreasing the volume, depending upon the pair of pegs 452 selected. The decorative attachment 410 used in conjunction with hearing aid 412 is comprised of decorative element 416 that has a first side 415 and a second side 417. Two conductive strips 458 are attached to the second side 417 of the decorative element 416 so that they are spaced apart from one another. A rod 460 has a first end 462, which is attached to the second side 417 of the decorative element 416, and a second end 464, which extends outwardly and generally normal to the decorative element 416. The hearing aid 412 has an orifice 466 intermediate and generally centered between the two pair of pegs 452. The rod 460 is cylindrical having a plurality of sides 468 with at least one of the sides 468 being unequal in width to the others. The orifice 466 is also cylindrical with a plurality of sides 469 that are sized and configured similar to the sides 468 of the rod 460, so that the orifice 466 may receive the second end 464 of the rod 460. By having one of the sides 468 of the rod 460 and one of the sides 469 of the orifice 466 a different width, the rod 460 will fit into the orifice 466 in only one way. The strips 458 are attached to the decorative element 416 so that each strip 458 is aligned with a respective pair of pegs 452 to ensure proper contact between a strip 458 and its corresponding pegs 452. The rod 460 and orifice 466 may be keyed by any well-known method to ensure that the decorative element 416 is not improperly attached to the hearing aid 412 causing the strips 458 to become misaligned with the pegs 452.

Figure 9:
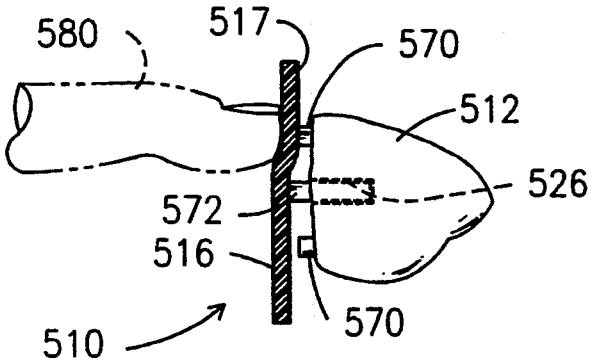
FIG. 9 is a side elevation of the invention of FIG. 8 illustrating the operation of the invention.
Figure 8:
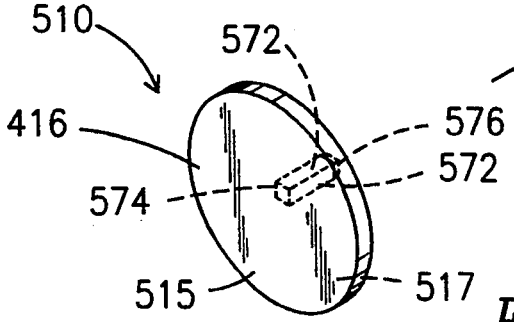
FIG. 8 is a perspective view of a sixth embodiment of this invention illustrating the attachment of the invention to a hearing aid.
Figure 8:
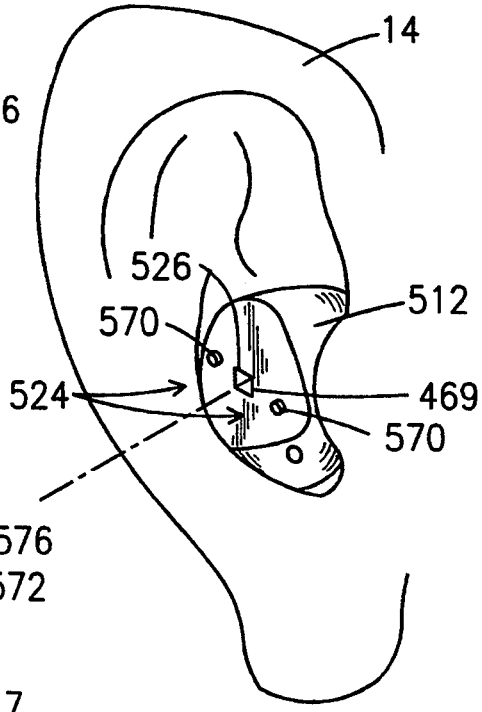

The embodiment of the decorative attachment 510 illustrated in FIGS. 8 and 9 is adapted for use with hearing aid 512 that comprises a pair of buttons 570 as the volume control 524. By pressing one of the buttons 570 the volume is increased and by pressing only the other button the volume is decreased. The decorative attachment 510 is comprised of a decorative element 516, having a first side 515 and a second side 517, and a dowel 572, having a first end 574 and a second end 576. The first end 574 of the dowel 572 is attached to the second side 517 of the decorative element 516 and extends outwardly therefrom. The second end 576 of the dowel is attached to the hearing aid 512. In this embodiment when the dowel 572 is attached to the hearing 512, the decorative item is spaced apart from the buttons; however, the decorative item in other embodiments may engage the buttons 570 without depressing them. In the embodiment illustrated in FIGS. 8 and 9, a recess 526 is formed in the hearing aid 512. The recess 526 is sized and configured to receive the second end 576 of the dowel 572 attaching the decorative element 516 to the hearing aid 512. The dowel 572 may also be attached by any well-known means including but not limited to gluing. The decorative element 516 is flexible so that by pressing on one side of the decorative element 516, as shown in FIG. 9, one of the buttons 570 is depressed thereby operating the volume control 524 of the hearing aid 512.

In each of the embodiments, decorative element 16, 116, 216, 316, 416 and 516, may be made from a light solid platic, or a plastic having a filagree design formed therein, or sound transparent materials, well known in the art, or any other suitable materials.

Having thus set forth a number of embodiments for the constructions of the decorative volume control attachment 10 of this invention, it is to be remembered that these are but a few preferred embodiments. There are many hearing aids currently on the market with varying means for controlling the volume. The invention may be adapted for attachment to existing models of hearing aids, or new hearing aid models may be designed with the attaching features constructed therein for easy attachment of the invention 10.

Attention is now invited to a description of the use of the decorative attachment 10, 110, 210, 310, 410 and 510. In each of the embodiments illustrated in FIGS. 1–9, the decorative volume control attachment of each embodiment may be first attached to the respective hearing aid prior to insertion of the hearing aid into the ear 14. Alternatively, the decorative attachment of each embodiment may be attached to the respective hearing aid after the hearing aid has been inserted in the ear 14. With the decorative attachment of each embodiment in place by either insertion of the shaft 20 into the recess 26, attachment of the receptor 238 to the volume control 224, insertion of rod 460 in orifice 466 or insertion of dowel 572 into recess 526, the decorative element 16, 116, 216, 316, 416, or 516 now conceals the corresponding hearing aid. In each embodiment additional decorative elements 16 through 516 may be provided with different decorative features, colors and patterns that are appropriate for different styles and fashions of clothing.

In embodiment 10 the volume control may be operated by rotation of the decorative element 16, adjusting the volume between a minimum and a maximum position. In embodiment 110 the volume is controlled by rotation of the knob 128. In embodiments 210 and 310 the decorative element 216 and 316, respectively, is rotated to adjust the volume level of the hearing aids 212 and 312 respectively. In embodiment 410, as illustrated in FIG. 7, the user pushes their finger 480 against the first side 415 of the decorative element 416 adjacent to one of the conductive strips 458. The decorative element 416 is sufficiently flexible that, when pressed, it bends to place a conductive strip 458 into contact with one pair of the pegs 452, closing one of the volume control circuits. The volume of the hearing aid 412 will be increased or decreased depending upon which pair of pins are contacted. In embodiment 510, the user presses their finger 580 into contact with the first side 515 of the decorative element 516. The decorative element 516 is sufficiently flexible so that, when pressed, the second side 517 of the decorative element 516 contacts the button 570 and depresses it actuating the volume control of the hearing aid 512, increasing the volume upwardly or downwardly depending upon which button 570 is pressed.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, What is claimed is:

1. A decorative and operative hearing aid attachment for a hearing aid having a generally cylindrical volume control knob, the volume control knob having an outwardly facing surface, in relation to the hearing aid, that is generally normal to the longitudinal axis of the volume control knob, said decorative attachment comprising:

a decorative element sized and configured to substantially shield a hearing aid when said hearing aid attachment is attached to the hearing aid; and a cup-shaped receptor comprising a bottom and at least one wall extending therefrom, said receptor having an outer bottom surface, and said decorative element being attached to said outer bottom surface; said receptor being sized and configured to receive the volume control knob therein such that rotation of said decorative element operates the volume control of the hearing aid.

2. A decorative attachment as in claim 1 wherein said decorative element is removably attachable to said receptor.

3. A decorative and operative attachment for a hearing aid having a cylindrical volume control knob, the volume control knob having an outwardly facing surface, in relation to the hearing aid, that is generally normal to the longitudinal axis of the volume control knob, and at least one hole extending inwardly from the outwardly facing surface, said decorative attachment comprising:

a decorative element sized and configured to substantially shield a hearing aid when said hearing aid attachment is attached to the hearing aid; and a cup-shaped receptor comprising a bottom and at least one wall extending therefrom, said receptor having an outer and an inner bottom surface, said decorative element being attached to said outer bottom surface, and said receptor further comprising at least one pin extending outwardly from said inner bottom surface, said receptor being sized and configured to receive the volume control knob therein so that said pin is received by the hole in the volume control knob, whereby rotation of said decorative element operates the volume control of the hearing aid.

4. A decorative and operative hearing aid attachment for a hearing aid having a volume control comprising two pairs of conductive pegs extending outwardly from the hearing aid, each one of said pairs comprising the open ends of an electrical circuit, wherein closing one circuit increases the volume and closing only the other circuit decreases the volume, and the hearing aid having an orifice therein intermediate the two pair of pegs, said decorative attachment comprising:

a decorative element sized and configured to substantially shield a hearing aid when said hearing aid attachment is attached to the hearing aid; and a pair of conductive strips attached to one side of said decorative item and a rod having a first end and a second end, said first end being connected to said decorative item intermediate said conductive strips such that when the second end of said rod is received by the orifice in the hearing aid each strip of said pair of strips is proximal and spaced apart from a respective pair of pegs, whereby when said decorative item is pressed proximal one of said strips said strip is moved into contact with the adjacent pair of pegs closing the circuit and thereby adjusting the volume of the hearing aid between a minimum and a maximum position.

5. A decorative and operative hearing aid attachment for use with a hearing aid having a volume control comprising a pair of buttons, wherein pressing one of the buttons increases the volume and pressing the other button decreases the volume, said decorative attachment comprising:

a flexible decorative element sized and configured to substantially shield a hearing aid when said hearing aid attachment is attached to the hearing aid; and a dowel having a first end and a second end, said second end being adapted for attachment to the hearing aid intermediate the buttons, and said first end being attached to said decorative element such that pressing one side of said flexible decorative element causes said decorative element to depress one of the buttons and pressing the other side of said decorative element causes said decorative element to depress the other one of the pair of buttons, thereby operating the volume control of the hearing aid between a minimum and a maximum position.

6. A decorative and operative hearing aid attachment for a hearing aid having a volume control knob, said decorative attachment comprising:

a decorative element sized and configured to substantially shield a hearing aid when said hearing aid attachment is attached to the hearing aid; and a snap fastener comprising two parts, one of said parts being attached to said decorative item and the other one of said parts being attached to the volume control knob of the hearing aid, such that when said parts of said snap fastener are attached to one another, rotation of said decorative element operates the volume control of the hearing aid.

* * * * *